US009559465B2

(12) United States Patent
Phillips et al.

(10) Patent No.: US 9,559,465 B2
(45) Date of Patent: Jan. 31, 2017

(54) HIGH SPEED SIGNAL-ISOLATING ELECTRICAL CONNECTOR ASSEMBLY

(71) Applicant: Tyco Electronics Corporation, Berwyn, PA (US)

(72) Inventors: Michael John Phillips, Camp Hill, PA (US); Michael Eugene Shirk, Grantville, PA (US); Bruce Allen Champion, Camp Hill, PA (US); Linda Ellen Shields, Camp Hill, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 247 days.

(21) Appl. No.: 14/445,160

(22) Filed: Jul. 29, 2014

(65) Prior Publication Data

US 2016/0036165 A1 Feb. 4, 2016

(51) Int. Cl.

| | |
|---|---|
| ***H01R 13/6461*** | (2011.01) |
| ***H01R 13/6471*** | (2011.01) |
| ***H01R 13/6587*** | (2011.01) |
| ***H01R 13/6585*** | (2011.01) |
| *H01R 12/72* | (2011.01) |

(52) U.S. Cl.

CPC ..... *H01R 13/6461* (2013.01); *H01R 13/6471* (2013.01); *H01R 13/6585* (2013.01); *H01R 13/6587* (2013.01); *H01R 12/724* (2013.01)

(58) Field of Classification Search

CPC ..... H01R 13/6587
USPC ..... 439/607.07, 607.1, 108
See application file for complete search history.

(56) References Cited

U.S. PATENT DOCUMENTS

| | | | | |
|---|---|---|---|---|
| 5,620,340 | A * | 4/1997 | Andrews | H01R 23/688 439/108 |
| 6,146,202 | A * | 11/2000 | Ramey | H01R 12/585 439/607.1 |
| 6,231,391 | B1 | 5/2001 | Ramey et al. | |
| 6,364,710 | B1 * | 4/2002 | Billman | H01R 13/2414 439/101 |
| 6,435,913 | B1 * | 8/2002 | Billman | H01R 23/688 439/107 |
| 6,527,587 | B1 * | 3/2003 | Ortega | H01R 23/688 439/607.05 |
| 6,676,450 | B2 * | 1/2004 | Schroll | H01R 13/6585 439/607.1 |
| 6,719,587 | B2 * | 4/2004 | Droesbeke | H01R 13/6589 439/607.1 |
| 7,381,092 | B2 * | 6/2008 | Nakada | H01R 13/514 439/607.1 |

(Continued)

FOREIGN PATENT DOCUMENTS

| | | |
|---|---|---|
| DE | 102012218490 | 4/2014 |
| EP | 1139498 | 10/2001 |

OTHER PUBLICATIONS

European Search Report dated Oct. 28, 2015 received in counterpart European Application No. EP 15178901.3.

*Primary Examiner* — Neil Abrams

(57) ABSTRACT

An electrical connector assembly may include a plurality of signal isolating barriers. Each of the plurality of signal isolating barriers may be positioned around a group of board contacts proximate to a board connecting interface. Each of the plurality of signal isolating barriers isolates the group of the plurality of board contacts from other groups of the plurality of board contacts.

16 Claims, 4 Drawing Sheets

(56) References Cited

U.S. PATENT DOCUMENTS

| | | | | |
|---|---|---|---|---|
| 7,513,797 | B2 * | 4/2009 | Scherer | H01R 23/688 439/607.01 |
| 7,722,399 | B2 * | 5/2010 | Scherer | H01R 23/688 439/607.05 |
| 7,789,676 | B2 * | 9/2010 | Morgan | H01R 13/65807 439/541.5 |
| 7,824,197 | B1 | 11/2010 | Westman et al. | |
| 7,862,344 | B2 * | 1/2011 | Morgan | H01R 13/6467 439/108 |
| 7,927,144 | B2 * | 4/2011 | Feldman | H01R 13/514 439/607.05 |
| 8,002,581 | B1 * | 8/2011 | Whiteman, Jr. | H01R 12/724 439/607.18 |
| 8,167,651 | B2 * | 5/2012 | Glover | H01R 12/585 439/607.08 |
| 8,202,118 | B2 * | 6/2012 | Cohen | H05K 1/14 439/607.1 |
| 8,371,876 | B2 * | 2/2013 | Davis | H01R 12/724 439/108 |
| 8,932,080 | B2 * | 1/2015 | Chang | H05K 7/1069 439/607.1 |
| 9,004,943 | B2 * | 4/2015 | Johnescu | H01R 13/6585 439/607.05 |
| 9,071,025 | B2 * | 6/2015 | Uozumi | H01R 13/659 |
| 2007/0099507 | A1 | 5/2007 | Ohnishi et al. | |
| 2011/0034075 | A1 | 2/2011 | Feldman | |
| 2014/0073173 | A1 * | 3/2014 | Yang | H01R 13/6461 439/485 |
| 2016/0036165 | A1 * | 2/2016 | Phillips | H01R 13/6461 439/607.05 |

* cited by examiner

HIGH SPEED SIGNAL-ISOLATING ELECTRICAL CONNECTOR ASSEMBLY

BACKGROUND OF THE DISCLOSURE

Embodiments of the present disclosure generally relate to electrical connector assemblies.

Various communication or computing systems use electrical connectors to transmit data signals between different components of the systems. An electrical connector may mechanically and electrically connect to a printed circuit board, for example. Often, differential pair signaling is used with respect to electrical systems. Typically, a differential pair includes a positive signal component and a negative signal component. Known connector assemblies may locate differential pairs in close proximity to one another. In doing so, however, the high speed signals transmitted by one differential pair may cross-talk or otherwise interfere with signals received by an adjacent differential pair, thereby degrading the performance of the connector assemblies and/or the systems in which the connector assemblies are used.

Known connector assemblies may be susceptible to cross-talk and interference between differential pairs at or near contact interfaces on a printed circuit board. High speed signals passing between a printed circuit board and a connector assembly may cross-talk or otherwise interfere with one another, which may degrade performance.

In general, as data rates continue to increase, there is a need to control electrical noise through electrical connector assemblies in order to achieve desired performance.

BRIEF DESCRIPTION OF THE DISCLOSURE

Certain embodiments of the present disclosure provide an electrical connector assembly that may include a plurality of high speed signal boards and a plurality of signal isolating barriers. Each of the high speed signal boards may include or otherwise carry or supports a plurality of board contacts, which may be configured to connect to a printed circuit board. Each of the signal isolating barriers may be positioned around a group of the board contacts. Each of the signal isolating barriers isolates the group of the board contacts from other groups of the board contacts. In at least one embodiment, each of the signal isolating barriers forms a box structure around the group of the board contacts. In at least one embodiment, the plurality of high speed signal boards may offset a subset of the plurality of board contacts from another subset of the plurality of board contacts.

Each of the plurality of isolating barriers may include parallel first portions of ground plates and second portions of ground isolator panels that connect to the parallel portions of ground plates. At least portions of the second portions may be perpendicular to the first portions. Each of the ground isolator panels may include a linear segment connected to an offset segment by an offsetting segment. Each of the second portions may include a contacting portion extending outwardly therefrom. In at least one embodiment, the contacting portion may include an eye-of-the-needle opening that resides within a plane that is perpendicularly oriented with respect to one or more planes in which the plurality of board contacts reside.

The group of the board contacts may include a differential pair of the board contacts. The other groups of the board contacts may include other differential pairs of the board contacts.

Certain embodiments of the present disclosure provide an electrical connector assembly that may include a plurality of signal isolating barriers. Each of the plurality of signal isolating barriers may be positioned around a group of board contacts proximate to a board connecting interface. Each of the plurality of signal isolating barriers isolates the group of the plurality of board contacts from other groups of the plurality of board contacts.

Certain embodiments of the present disclosure provide an electrical connector assembly that may include a main housing, a plurality of high speed signal boards retained by the main housing, and a plurality of signal isolating barriers retained by the main housing. Each of the plurality of high speed signal boards may include a plurality of board contacts. The plurality of high speed signal boards offset a subset of the plurality of board contacts from another subset of the plurality of board contacts. Each of the plurality of signal isolating barriers provides a box structure positioned around a differential pair of the plurality of board contacts. Each of the plurality of signal isolating barriers isolates the differential pair of the plurality of board contacts from other differential pairs of the plurality of board contacts. Each of the plurality of isolating barriers may include parallel first portions of ground plates and second portions of ground isolator panels that connect to the parallel portions of ground plates. Each of the ground isolator panels may include a linear segment connected to an offset segment by an offsetting segment and an eye-of-the-needle contacting portion extending from at least one of the linear segment, the offset segment, and the offsetting segment.

DETAILED DESCRIPTION OF THE DISCLOSURE

Embodiments of the present disclosure provide electrical connector assemblies that eliminate, minimize, or otherwise reduce cross-talk, interference, and the like between electrical contacts, which may be proximally located near one another. In at least one embodiment, one or more grounding members form a shielding or isolating barrier around one or more board contacts, thereby isolating them from neighboring board contacts, which may be or include terminal ends of an electrical signal path within an electrical connector assembly. In at least one other embodiment, the board contacts may be offset, shifted, or otherwise staggered with respect to one another to increase the distance therebetween in order to reduce cross-talk, interference, or the like.

Figure 1:
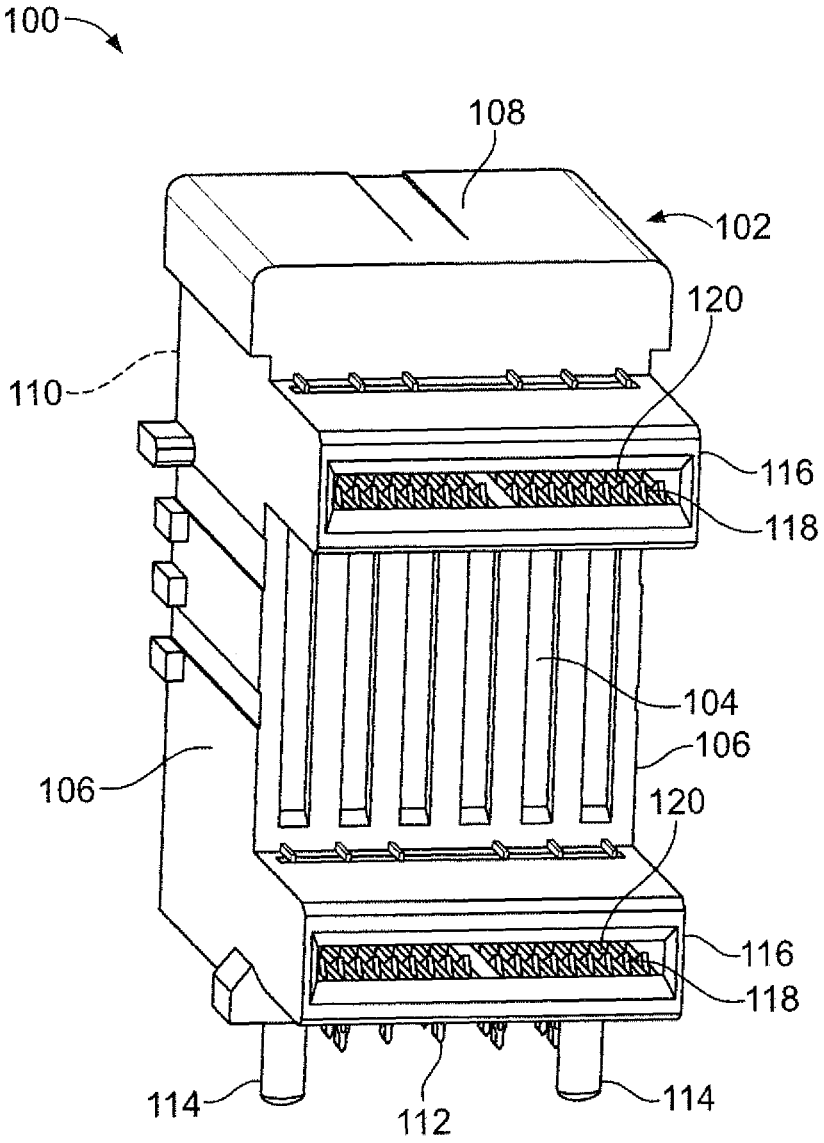
FIG. 1 illustrates a perspective front view of an electrical connector assembly, according to an embodiment of the present disclosure.

FIG. 1 illustrates a perspective front view of an electrical connector assembly 100, according to an embodiment of the present disclosure. The electrical connector assembly 100 may include a main housing 102 having a front wall 104 connected to lateral walls 106, which in turn may be connected to an upper surface 108, and a rear wall 110. The lower surface of the connector assembly 100 may be open, such that board contacts 112 extend therethrough. Optionally, the lower surface may include openings that allow individual mating components of the board contacts 112 to pass therethrough.

The board contacts 112 may be or include contacts that are configured to connect to a host board, such as a printed circuit board. The board contacts 112 may be terminal ends of signal contacts or paths that extend through signal boards within the electrical connector assembly 100. For example, the board contacts 112 may be configured to pass into, onto, or through a board connection interface between the connector assembly 100 and a printed circuit board (not shown) to which the connector assembly 100 may be mounted on or otherwise connected. For example, the board connection interface may be or include a bottom surface of the electrical connector assembly 100 that is configured to abut into a printed circuit board.

Alignment posts 114 may downwardly extend from lower edges of the lateral walls 106, the front wall 104, and/or the rear wall 110. The alignment posts 114 may be configured to be retained within reciprocal cavities formed in a printed circuit board to align and locate the connector assembly 100 with respect to the printed circuit board. As such, the board contacts 112 are configured to be aligned with and retained within reciprocal openings, such as plated through-holes or vias, of the printed circuit board.

As shown, two receptacle shrouds 116 may extend outwardly from the front wall 104. Alternatively, the electrical connector assembly 100 may include more or less receptacle shrouds 116 than shown. Each receptacle shroud 116 defines an internal chamber 118 that retains a plurality of mating contacts 120 that are configured to electrically mate with mating contacts of a reciprocal electrical connector assembly, such as a plug-style electrical connector assembly. Optionally, the electrical connector assembly 100 may be a plug-style electrical connector assembly.

The mating contacts 120 extend from or are otherwise supported by or connected to signal boards, such as wafers, cards, or the like, retained within the electrical connector assembly 100. The signal boards may include traces, contacts, and/or other signal paths that connect a mating contact 120 to a respective board contact 112.

The board contacts 112 may connect or otherwise terminate to a printed circuit board (not shown). The board contacts 112 connect to signal traces, paths, or the like that extend through boards, such as high speed signal boards, retained within the electrical connector assembly 100.

Figure 2:
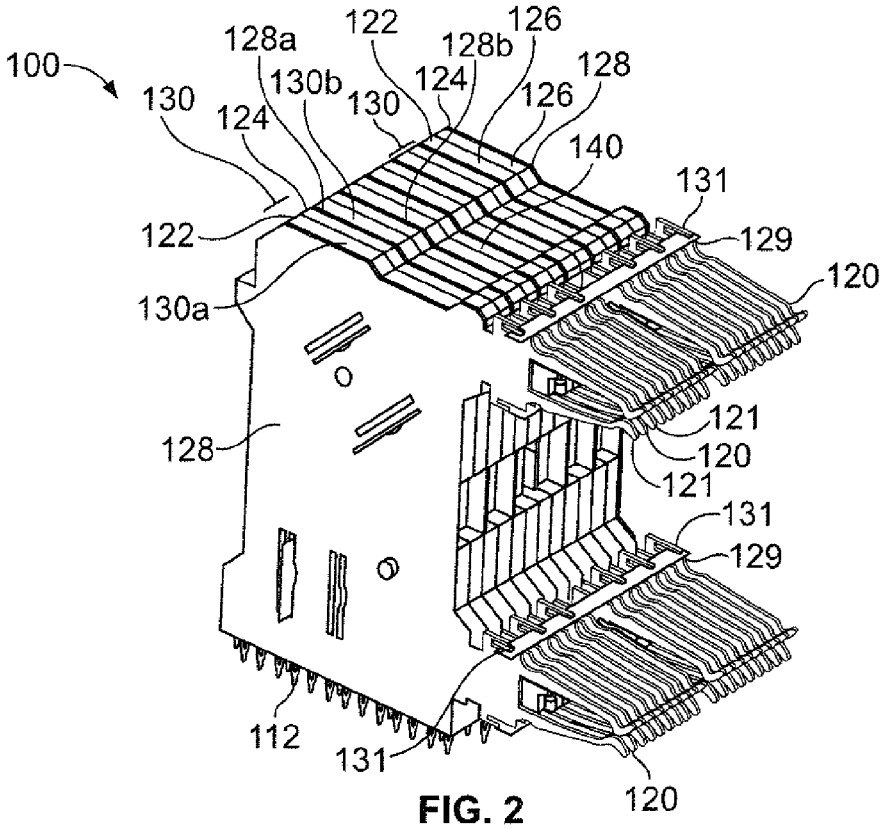
FIG. 2 illustrates a perspective top internal view of an electrical connector assembly, according to an embodiment of the present disclosure.

FIG. 2 illustrates a perspective top internal view of the electrical connector assembly 100, according to an embodiment of the present disclosure. For the sake of clarity, the main housing 102 is not shown in FIG. 2. The electrical connector assembly 100 may include a plurality of high speed signal boards 122 and 124 abutting one another. Each high speed signal board 122 and 124 may include a dielectric substrate 126, such as formed of plastic, which supports an electrical path, trace, or the like between a mating contact 120 and a board contact 112. The board contacts 112 and the mating contacts 120 may be carried by the high speed signal boards 122 and 124. For example, the dielectric substrate 126 may provide a plastic over-molded body that supports one or more mating contacts 120, which connect to respective board contacts 112 through electrical traces, paths, or the like that pass through or on the dielectric substrate.

Each signal board 122 may abut a signal board 124. A ground plate 128 is positioned on one side of a high speed signal board 122, while another ground plate is positioned on an opposite side of a high speed signal board 124. Thus, a board pair 130 may be sandwiched between opposed ground plates 128. As shown in FIG. 2, a first board pair 130*a* is separated from a second board pair 130*b* by a ground plate 128*a*. The second board pair 130*b* is isolated from low speed boards (such as power boards) 140 by a ground plate 128*b*. The individual low speed boards may or may not be separated by separate ground plates. Alternatively, instead of board pairs, individual signal boards 122 or 124 may be sandwiched between ground plates 128.

As shown, the high speed board pairs 130 may be located towards lateral walls 106 of the main housing 102 (shown in FIG. 1), while the low speed boards 140 may be located proximate a middle section of the main housing 102. Alternatively, the connector assembly 100 may include more or less board pairs 130 than shown. For example, the connector assembly 100 may include all high speed signal boards 122 and 124 grouped in board pairs 130 separated by ground plates 128, and no low speed boards 140. Alternatively, the connector assembly 100 may include more or less low speed boards 140 than shown.

Figure 3:
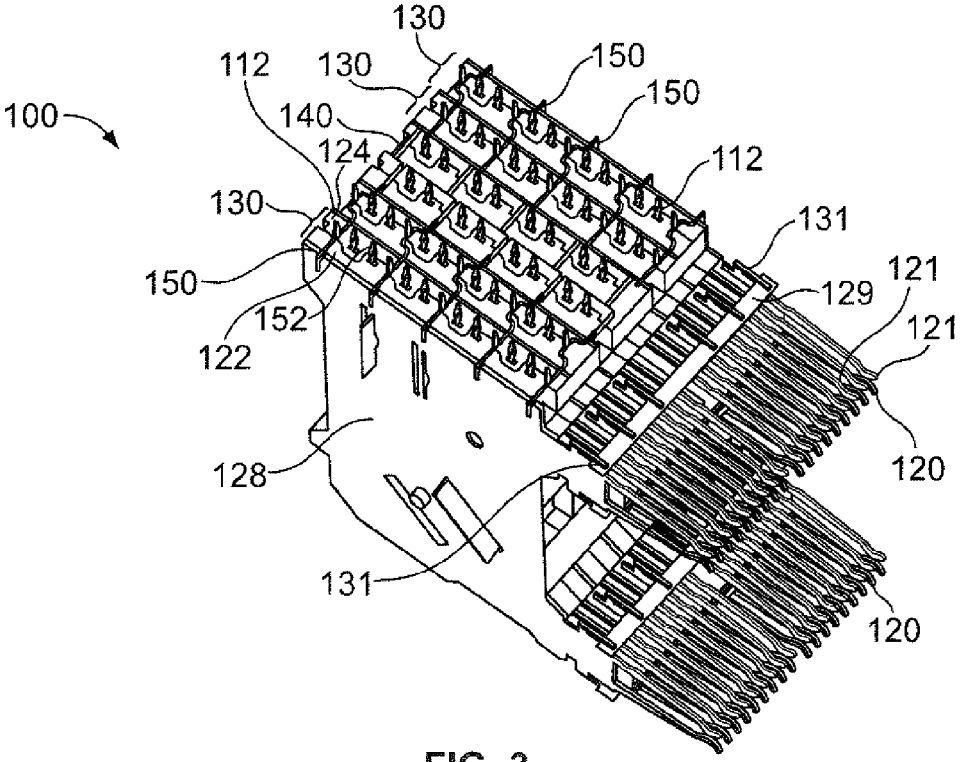
FIG. 3 illustrates a perspective bottom internal view of an electrical connector assembly, according to an embodiment of the present disclosure.

FIG. 3 illustrates a perspective bottom internal view of the electrical connector assembly 100, according to an embodiment of the present disclosure. For the sake of clarity, the main housing is not shown in FIG. 3. The electrical connector assembly 100 may include crossing ground isolator panels 150, such as grounding cross bars, walls, beams, straps, or the like, that extend across at least a lower portion of the connector assembly 100, such as at or proximate to a board connection interface. The ground isolator panels 150 may be perpendicular to the ground plates 128. As shown, the ground isolator panels 150 and the ground plates 128 isolate differential pairs of board contacts 112 from one another. For example, the ground isolator panels 150 and the ground plates 128 cooperate to form a matrix or pattern of signal isolating barriers 152, such as areas, regions, units, cells, or the like, that separate groups of board contacts 112, such as differential pairs of board contacts 112, from other groups of board contacts 112, such as another differential pair of board contacts.

As shown in FIGS. 2 and 3, planar ground connecting beams 129 may connect to and extend between ground prongs 131 of the ground plates 128. The ground connecting beams 129 interconnect the ground plates 128 to one another and span across the electrical connection assembly 100 between the lateral walls 106. For example, the ground connecting beams 129 may be perpendicular to the ground plates 128. The ground connecting beams 129 may tie the ground plates 128 together. Alternatively, the electrical connector assembly 100 may not include the ground connecting beams 129.

The ground plates 128 may extend along sides of the high speed signal boards 122 and 124. As shown, a set of high speed signal boards 122 and 124 may be sandwiched between two ground plates 128. Each ground plate 128 may include grounding contacts 121 interleaved between the mating contacts 120. As such, the high speed signal boards 122 and 124 may be shielded entirely from mating ends to mounting ends.

Figure 4:
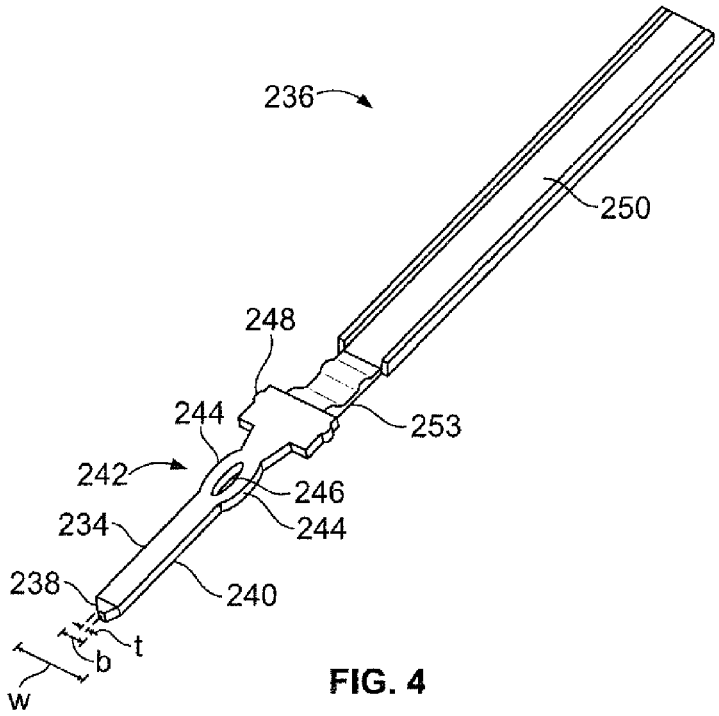
FIG. 4 illustrates a perspective view of a board contact, according to an embodiment of the present disclosure.

FIG. 4 illustrates a perspective view of a board contact 236, according to an embodiment of the present disclosure. The board contact 236 may be an example of a board contact 112. For example, the board contact 236 may extend from a lower end of a dielectric substrate of a signal board, and connect to a signal path or trace that extends within, through, or on the dielectric substrate. It is to be understood, however, that various other types of electrical contacts may be used instead of the board contact 236 shown and described with respect to FIG. 4.

The board contact 236 may be retained by the electrical connector assembly 100 (shown in FIG. 1). For example, the board contact 236 may extend downwardly from a high speed signal board 122 or 124 (shown in FIGS. 2 and 3). The board contact 236 may be formed of a conductive material, such as a metal. Each board contact 236 may include an end portion, such as a contact tail 234 having a beveled distal tip 238. The beveled distal tip 238 may be configured to slide into a through-hole formed within a printed circuit board. Because the beveled distal tip 238 may have a smaller diameter or width than the through-hole, the contact tail 234 is able to easily pass into the through-hole. The distal tip 238 may integrally connect to a beam 240 having a width b that is greater than the diameter of the tip 238. The beam 240 is configured to securely abut into plated walls of the printed circuit board that define a through-hole. The beam 240 may, in turn, be integrally connected to an expanded eye-of-the-needle contacting portion 242. The contacting portion 242 includes opposed outwardly-bowed legs 244 separated by an internal opening 246. The legs 244 are configured to securely abut into conductive wall portions of the through-hole so that signals may pass from the board contact 236 to the printed circuit board, or vice versa.

The contacting portion 242 may, in turn, be integrally connected to a receptacle-retaining block 248 having a width w greater than the width b of the beam 240. The block 248 may be configured to be securely retained within a channel formed within a high speed signal board 122 or 124 (shown in FIGS. 2 and 3). The block 248 may, in turn, be integrally connected to another end portion, such as an extension blade 250 that may be retained within a channel formed through the high speed signal board 122 or 124. As shown, the blade 250 may be a planar blade that is offset with respect to the block 248 through a curved intermediate section 253. Optionally, the entirety of the board contact 236 may lie within a common plane. The block 248 may be sized shorter or longer than that shown in FIG. 4, in order to be sized and shaped to be securely retained by a reciprocal channel formed within the high speed signal board 122 or 124.

In a differential pair, one of the board contacts 236 may be a flat planar structure, while the other of the board contacts 236 may include the curved intermediate section 253. In this manner, the contacting portions 242 of the board contacts of the differential pair may reside within a common plane.

The blade 250 of each board contact 236 retained within the high speed signal board 122 or 124 of the electrical connector assembly 100 may electrically connect to a mating contact 120 (shown in FIGS. 2 and 3) through a signal trace, path, or another connecting member retained within the high speed signal board 122 or 124. Optionally, the board contact 236 may be various other conductive contacts that may be used within a connector housing. For example, the board contact 236 may include ball/socket, tab/slot, or the like, mating connective ends.

Figure 5:
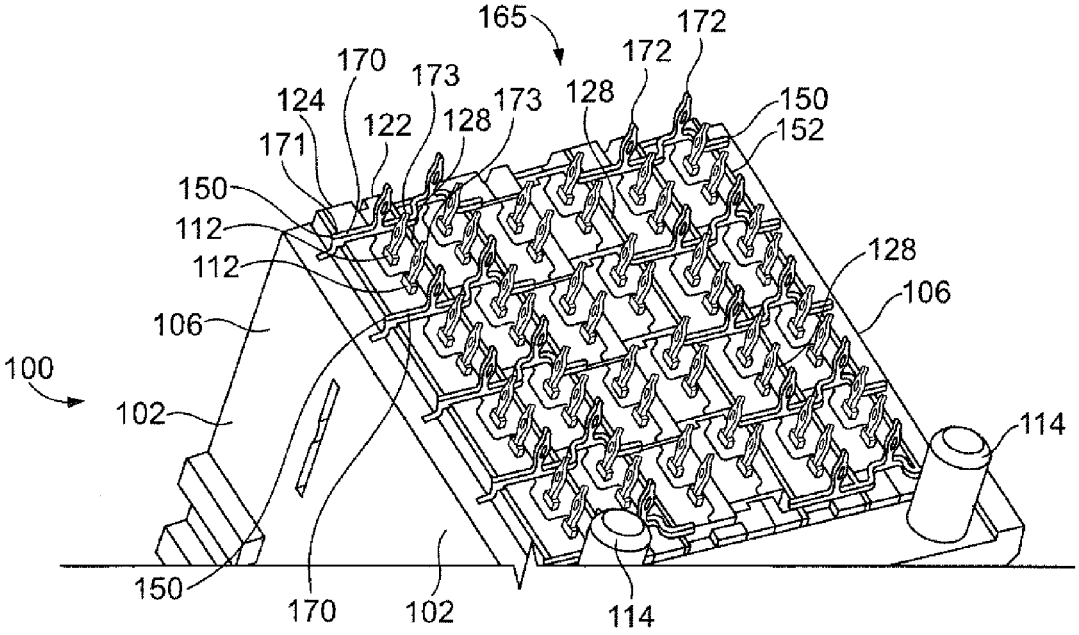
FIG. 5 illustrates a perspective bottom view of a bottom face of an electrical connector assembly, according to an embodiment of the present disclosure.

FIG. 5 illustrates a perspective bottom view of a bottom face 165 (such as a board connection interface) of the electrical connector assembly 100, according to an embodiment of the present disclosure. As shown, the ground plates 128 and the ground isolator panels 150 that run crosswise with respect to the ground plates 128 cooperate to form a plurality of signal isolating barriers 152, each of which surrounds one set of differential pairs of board contacts 112. The high speed signal board 124 includes a plurality of board contacts 112 that may align with a plurality of board contacts 112 of an adjacent signal board 122. A ground plate 128 is positioned to one side of the aligned board contacts 112, while another ground plate 128 is positioned to an opposite side of the aligned board contacts 112. A ground isolator segment 170 is positioned forward of a pair of aligned board contacts 112, while another ground isolator segment 170 is positioned rearward of the pair of aligned board contacts 112.

As shown, each ground isolator segment 170 of a ground isolator panel 150 may include a contacting portion 172 (such as an eye-of-the-needle contacting portion) that extends downwardly therefrom. The contacting portion 172 may be a compliant pin having deflectable legs that reside in a plane 171. The plane 171 may span linearly between lateral walls 106 of the main housing 102. The plane 171 may be perpendicular to the lateral walls 106. As shown, the contacting portions 173 of the board contacts 112 may reside within planes that are perpendicular to the plane 171. The contacting portion 172 may be perpendicular to aligned contacting portions 173 of the board contacts 112 of a differential pair. For example, while the contacting portions 173 of the board contacts 112 are parallel with the ground plates 128, the contacting portions 172 are perpendicular to the ground plates 128. In this manner, the perpendicular contacting portions 172 may provide increased surface area for shielding the board contacts 112 from one another. In at least one other embodiment, the contacting portions 172 may also be parallel with the ground plates 128, and may therefore be aligned in a parallel fashion with the contacting portions of the board contacts 112. Alternatively, the ground isolator segments 170 may not include board contacts.

Figure 6:
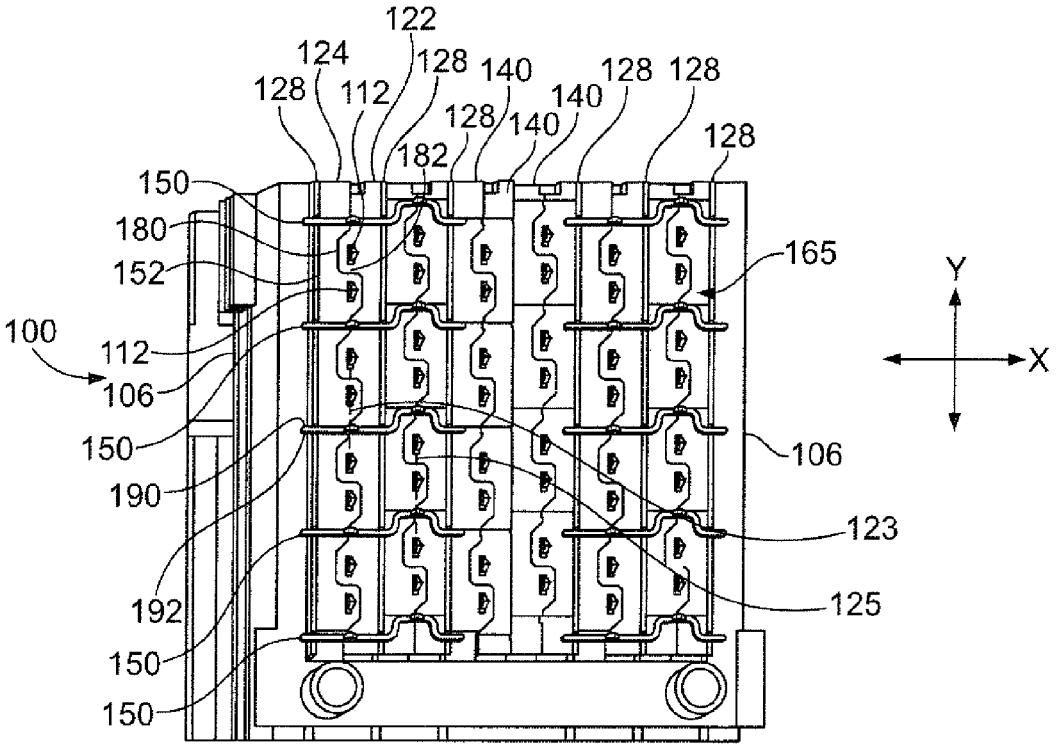
FIG. 6 illustrates a bottom plan view of a bottom surface of an electrical connector assembly, according to an embodiment of the present disclosure.

FIG. 6 illustrates a bottom plan view of a bottom surface of the electrical connector assembly 100, according to an embodiment of the present disclosure. As shown, the high speed signal boards 122 and 124 may interlock with one another. For example, the high speed signal board 124 may include a recessed area 180 into which a complementary extended portion 182 of the high speed signal board 122 fits. Each high speed signal board 122 and 124 may include alternating recessed areas 180 and extended portions 182. As such, the high speed signal boards 122 and 124 may connect to one another such that respective board contacts 112 are aligned in a linear fashion, such as in vertical columns (or aligned along the Y axis, as shown in FIG. 6). For example, as shown in FIG. 6, the board contacts 112 of the high speed boards 122, 124 are aligned along respective parallel axes 123, 125. Alternatively, the high speed signal boards 122 and 124 may be or include flat planar sheets with no recessed area or extended portions.

Each ground isolator panel 150 may be or include a metal ground plate, sheet, wall, or the like that extends from the bottom face 165 to an intermediate area within the electrical connector assembly 100. For example, the ground isolator panel 150 may be the same or similar length or height as that of a board contact 112 (or 236). Alternatively, each ground isolator panel 150 may extend a greater or lesser distance from the bottom face 165 to an intermediate area within the electrical connector assembly 100. For example, each ground isolator panel 150 may be as tall as each ground plate 128.

As shown, each ground plate 128 includes a plurality of slots 190, each of which is configured to retain a reciprocal tab 192 of a ground isolator plate 150. For example, the tabs 192 may nest within the slots 190. The tabs 192 of the ground isolator plates 150 may be securely retained within the slots 190 of the ground plates 128, such as through an interference fit. As such, the ground isolator plates 150 securely connect to the ground plates 128 to form the matrix or pattern of signal isolating barriers 152.

The ground isolator plates 150 may extend across the electrical connector assembly 100 only through the high speed signal boards 122 and 124. The ground isolator panels 150 may not extend through the low speed boards 140. Alternatively, the ground isolator panels 150 may extend across an entire width of the electrical connector assembly 100 from one lateral wall 106 to an opposite lateral wall 106.

Figure 7:
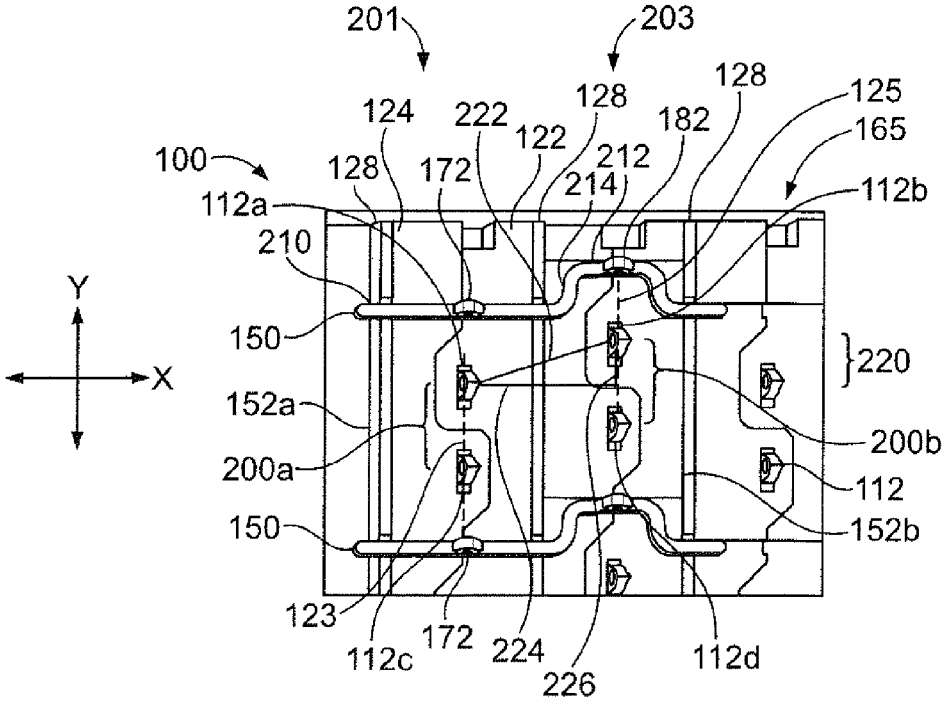
FIG. 7 illustrates a bottom plan view of signal isolating barriers of an electrical connector assembly, according to an embodiment of the present disclosure.

FIG. 7 illustrates a bottom plan view of signal isolating barriers 152*a* and 152*b* of the electrical connector assembly 100, according to an embodiment of the present disclosure. Each signal isolating barrier 152*a* and 152*b* may define an area that isolates a differential pair 200*a* of board contacts 112 from another differential pair 200*b* of board contacts 112. For example, the differential pair 200*a* may be a transmitting differential pair, while the differential pair 200*b* may be a receiving differential pair. As such, the differential pairs 200*a* and 200*b* may define a channel, such that one of the differential pairs 200*a* and 200*b* is a transmitting differential pair, while the other of the differential pairs 200*b* is a receiving differential pair. The signal isolating barriers 152*a* and 152*b* separate the transmitting differential pair from the receiving differential pair in order to eliminate, minimize, or otherwise reduce cross-talk, interference, and the like between the differential pairs 200*a* and 200*b*.

A differential pair is a pair of conductors used for differential signaling. In general, differential pairs reduce cross-talk and electromagnetic interference. Additionally, differential pairs are well-suited for high speed data transmission. One board contact 112 of a differential pair 200*a* or 200*b* may be a positive signal contact, while the other board contact 112 of the differential pair 200*a* or 200*b* may be a negative signal contact, or vice versa.

Each ground isolating panel 150 may include a linear segment 210 that connects to an offset segment 212 by an offsetting segment 214, such as a curved or linear wall that may generally be perpendicular to the linear segment 210 and the offset segment 212. The ground isolating panels 150 may include offset segments 212 in order to accommodate the offset nature of the differential pairs 200*a* and 200*b*.

FIG. 7 shows mutually perpendicular axes which may be termed as horizontal axis X and vertical axis Y for reference with respect to the plane of the drawing. The differential pair 200*a* may be vertically shifted or offset from the differential pair 200*b* such that the distance between upper board contacts 122*a* and 122*b* (and lower board contacts 112*c* and 112*d*) is further apart than if such contacts 112 were horizontally aligned. For example, the upper board contact 112 of the differential pair 200*b* is shifted a vertical distance 220 from the upper board contact 112 of the differential pair 200*a*. As such, a diagonal line 222 between centers of the upper board contacts 112 of the differential pairs 200*a* and 200*b* is greater than a horizontal line 224 from a center of the upper board contact 112 of the differential pair 200*a* to an intersection with a vertical line 226 that extends downwardly from a center of the upper board contact 112 of the differential pair 200*b*. The offset, shifted, or staggered alignment between the adjacent differential pairs 200*a* and 200*b* increases the distance therebetween. Increasing the distance between the differential pairs 200*a* and 200*b* reduces the likelihood of cross-talk, interference, or the like. For example, cross-talk or interference attenuates with increased distance. As shown in FIG. 7, the differential pair 200*a* in column 201 may be shifted a half pitch with respect to the differential pair 200*b* in column 203. Alternatively, the shift between the differential pairs 200*a* and 200*b* may be greater or less than a half pitch.

Accordingly, each differential pair 200*a* and 200*b* may be shielded from another differential pair by a signal isolating barrier 152*a* and 152*b*, which may include vertical wall segments of ground plates 128 and crosswise portions of ground isolating panels 150. Each signal isolating barrier 152*a* and 152*b* may include one differential pair 200*a* and 200*b*, respectively. The signal isolating barrier 152*a* may be rectangular in shape, while the signal isolating barrier 152*b* may be defined by a shape dictated, in part, by the offset segments 212.

The signal isolating barriers 152*a* and 152*b* surround the differential pairs 200*a* and 200*b*, respectively. For example, the signal isolating barrier 152*a* is positioned around the differential pair 200*a*, thereby isolating the differential pair 200*a* from other differential pairs. The signal isolating barrier 152*a* may surround or shield the differential pair 200*a* on all sides in the plane of the X and Y axes. Additionally, the plane of the board contacts 172 of the ground isolator panels 150 may be perpendicular to the plane of the board contacts 112. As such, the board contacts 172 provide a shielding surface of increased area.

Each signal isolating barrier 152 may provide a protective, shielding, or isolating member, such as a sleeve, chute, box, channel, wall, or the like, that surrounds a board contact or group of board contacts (such as a differential pair). The signal isolating barrier 152 shields or otherwise isolates the board contact or group of board contacts from another board contact or group of board contacts, thereby eliminating, minimizing, or otherwise reducing cross-talk or interference therebetween.

Each signal isolating barrier 152 may be defined by grounding members, such as portions of the ground plates 128 and portions of the ground isolating panels 150, that surround a board contact or a group of board contacts (such as the differential pair 200*a*) on at least four sides (for example, top, bottom, and lateral portions) at or proximate an interface with a printed circuit board. The ground members may form a full perimeter shielding structure around each of the differential pairs 200*a* and 200*b*, for example. The ground isolator panels 150 may be cross-connected with the ground plates 128 to form box-like shielding signal isolating barriers 152.

The board contacts or groups of board contacts (such as the differential pairs 200*a* and 200*b*) may be shifted, offset, or staggered with respect to one another, in order to increase the distance therebetween. The increased distance reduces the possibility of cross-talk or interference therebetween.

Alternatively, the differential pairs 200*a* and 200*b* may not be offset or shifted with respect to one another. Instead, the differential pairs 200*a* and 200*b* may be aligned with respect to one another in relation to the X axis. In this embodiment, the ground isolating panels 150 may not include offset segments, but may instead be linear panels, the entireties of which are parallel with the X axis.

Also, alternatively, the signal isolating barriers 152 may be used with respect to various types of signal contacts, whether or not they are differential pairs. For example, a single signal contact may be isolated within each isolating region.

Embodiments of the present disclosure provide an electrical connector assembly that eliminates, minimizes, or otherwise reduces cross-talk, interference, and the like between signal contacts, particularly at or proximate to an interface of or with a printed circuit board. Ground plates within the electrical connector assembly may cross connect with ground isolating panels, such as ground cross bars, which may include a board contact that is perpendicularly oriented with respect to high speed signal board contacts. Embodiments of the present disclosure may provide a full perimeter shield around a board contact or group of board contacts (such as a differential pair), such as at or proximate to an interface with a printed circuit board. Further, embodiments of the present disclosure may shift, offset, or otherwise stagger adjacent board contacts with respect to one another, thereby further reducing cross-talk, interference, or the like.

While various spatial terms, such as upper, bottom, lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An electrical connector assembly, comprising:

a main housing;

a plurality of high speed signal boards retained by the main housing, wherein each of the plurality of high speed signal boards supports a plurality of board contacts, wherein the plurality of high speed signal boards offset a subset of the plurality of board contacts from another subset of the plurality of board contacts; and a plurality of signal isolating barriers retained by the main housing, wherein each of the plurality of signal isolating barriers provides a box structure positioned around a differential pair of the plurality of board contacts, wherein each of the plurality of signal isolating barriers isolates the differential pair of the plurality of board contacts from other differential pairs of the plurality of board contacts, wherein each of the plurality of isolating barriers comprises parallel first portions of ground plates and second portions of ground isolator panels that connect to the parallel portions of ground plates, and wherein each of the ground isolator panels comprises a linear segment connected to an offset segment by an offsetting segment and an eye-of-the-needle contacting portion extending from at least one of the linear segment, the offset segment, and the offsetting segment.

2. An electrical connector assembly, comprising:

a plurality of high speed signal boards, wherein each of the plurality of high speed signal boards supports a plurality of board contacts; and a plurality of signal isolating barriers, wherein each of the plurality of signal isolating barriers is positioned around a group of the plurality of board contacts, wherein each of the plurality of signal isolating barriers isolates the group of the plurality of board contacts from other groups of the plurality of board contacts, wherein each of the plurality of isolating barriers comprises parallel first portions of ground plates and second portions of ground isolator panels that connect to the parallel portions of ground plates, and wherein each of the ground isolator panels comprises a linear segment connected to an offset segment by an offsetting segment in order to maintain uniform spacing with respect to the plurality of board contacts.

3. The electrical connector assembly of claim 2, wherein the plurality of high speed signal boards offset a subset of the plurality of board contacts from another subset of the plurality of board contacts.

4. The electrical connector assembly of claim 2, wherein at least portions of the second portions are perpendicular to the first portions.

5. The electrical connector assembly of claim 2, wherein each of the second portions comprises a contacting portion extending outwardly therefrom.

6. The electrical connector assembly of claim 5, wherein the contacting portion comprises an eye-of-the-needle opening that resides in a first plane that is perpendicularly oriented with respect to one or more second planes in which the plurality of board contacts reside.

7. The electrical connector assembly of claim 2, wherein the group of the plurality of board contacts comprises a differential pair of the plurality of board contacts, and wherein the other groups of the plurality of board contacts comprise other differential pairs of the plurality of board contacts.

8. The electrical connector assembly of claim 2, wherein each of the plurality of signal isolating barriers forms a box structure around the group of the plurality of board contacts.

9. The electrical connector assembly of claim 2, further comprising a plurality of ground plates, wherein each of the plurality of ground plates extends along one side of at least one of the plurality of high speed signal boards.

10. The electrical connector assembly of claim 9, wherein at least a portion of each of the plurality of ground plates forms at least a portion of one of the plurality of signal isolating barriers.

11. The electrical connector assembly of claim 9, wherein each of the plurality of ground plates comprises at least one grounding contact, wherein a plurality of grounding contacts are interleaved between a plurality of mating contacts of the plurality of high speed signal boards, wherein each of the plurality of ground plates is shielded entirely on either side from a mating end to a mounting end by one of a plurality of ground plates.

12. An electrical connector assembly, comprising:

a plurality of signal isolating barriers, wherein each of the plurality of signal isolating barriers is positioned around a group of board contacts proximate to a board connecting interface, wherein each of the plurality of signal isolating barriers isolates the group of board contacts from other groups of the board contacts, wherein each of the plurality of signal isolating barriers comprises parallel first portions of ground plates and second portions of ground isolator panels that connect to the parallel first portions of ground plates, and wherein each of the ground isolator panels comprises a linear segment connected to an offset segment by an offsetting segment in order to maintain uniform spacing with respect to the board contacts.

13. The electrical connector assembly of claim 12, wherein the group of board contacts is offset with respect to a neighboring group of board contacts.

14. The electrical connector assembly of claim 12, wherein at least portions of the second portions are perpendicular to the first portions.

15. The electrical connector assembly of claim 12, wherein each of the second portions comprises a contacting portion extending outwardly therefrom, and wherein the contacting portion comprises an eye-of-the-needle opening that resides within a first plane that is perpendicularly oriented with respect to one or more second planes in which the board contacts reside.

16. The electrical connector assembly of claim 12, wherein each of the plurality of signal isolating barriers forms a box structure around the group of board contacts.

* * * * *